United States Patent [19]

Lindner

[11] Patent Number: 4,558,545

[45] Date of Patent: Dec. 17, 1985

[54] FOUNDATION FOR A MAST, SUPPORTING PILLAR, AND THE LIKE

[75] Inventor: Karl B. Lindner, Torshälla, Sweden

[73] Assignee: Eskilstuna Invest AB, Eskilstuna, Sweden

[21] Appl. No.: 443,041

[22] Filed: Nov. 19, 1982

[30] Foreign Application Priority Data

Nov. 19, 1981 [DE] Fed. Rep. of Germany ..... 3145882

[51] Int. Cl.[4] ..... E02D 27/00

[52] U.S. Cl. ..... 52/169.13; 52/296; 405/249

[58] Field of Search ..... 52/292, 169.13, 296, 52/301; 405/184, 243, 233, 249, 250

[56] References Cited

U.S. PATENT DOCUMENTS

| | | | |
|---|---|---|---|
| 109,337 | 11/1870 | Moseley | 405/253 |
| 574,729 | 1/1897 | Gillespie | 405/230 |
| 633,298 | 9/1899 | Washington | 405/249 |
| 701,559 | 6/1902 | Goerke | 405/249 |
| 1,071,523 | 8/1913 | Lally | 52/296 |
| 2,098,343 | 11/1937 | Lawton | 52/292 |
| 2,129,978 | 9/1938 | Yokoyama | 405/249 X |
| 2,975,846 | 3/1961 | Bodine | 74/61 |
| 3,686,877 | 8/1972 | Bodin | 405/249 |
| 4,268,192 | 5/1981 | Colle | 405/239 |

FOREIGN PATENT DOCUMENTS 333106 11/1958 Sweden .

*Primary Examiner*—Donald G. Kelly
*Assistant Examiner*—Kathryn Ford
*Attorney, Agent, or Firm*—Richard P. Crowley

[57] ABSTRACT

A foundation for a mast, supporting pillar, rails, and the like, comprising an anchoring portion (2) of hollow section design open at the bottom and adapted to be driven into the ground by being vibrated, and a inner (3,3'), and, if desired, and outer (4) ground consolidating element. Preferably at least the inner ground consolidating element (3) is arranged for longitudinal displacement inside the anchoring portion (2) so that the earth entering from below into the interior of the anchoring portion (2) is consolidated during the entire period of sinking the anchoring portion (2) into the ground by vibrating it. In similar manner, also the outer ground consolidating element (4) may be arranged to be displaceable in longitudinal direction.

A vibrator suspended from construction equipment or an airship and lowered from the same under loading which acts on the anchoring portion and corresponds approximately to the dead weight of the vibrator (about 1.5 to 3.5 tons) is connected to the upper end of the anchoring portion (2) to sink the same into the ground by vibrating it. The anchoring portion (2) of hollow section design has extremely thin walls as compared to its length and width.

17 Claims, 5 Drawing Figures

FIG. 1
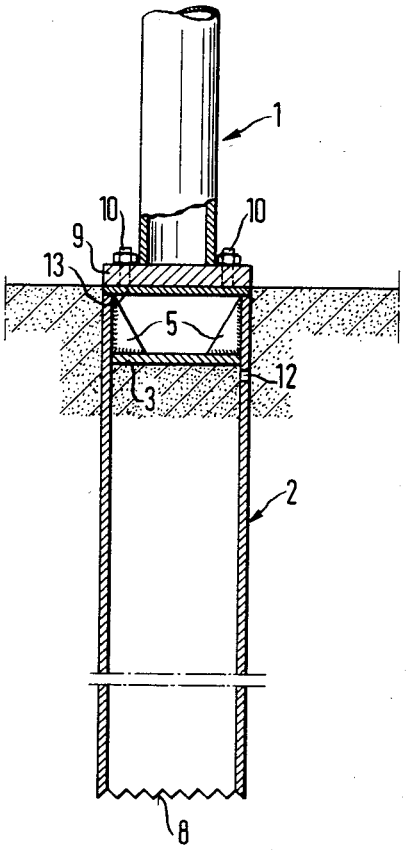
FIG. 2
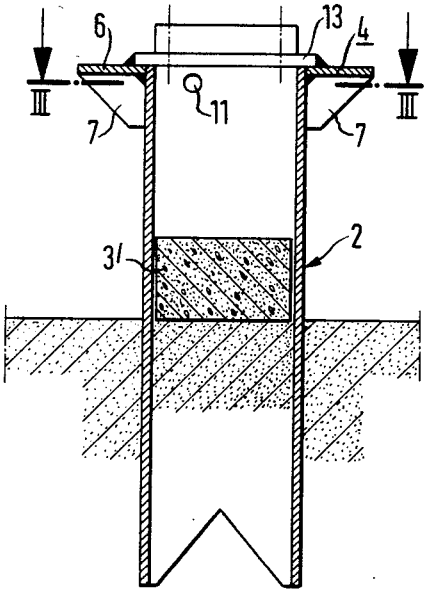
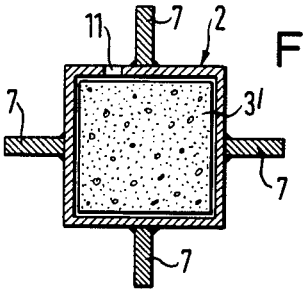
FIG. 3

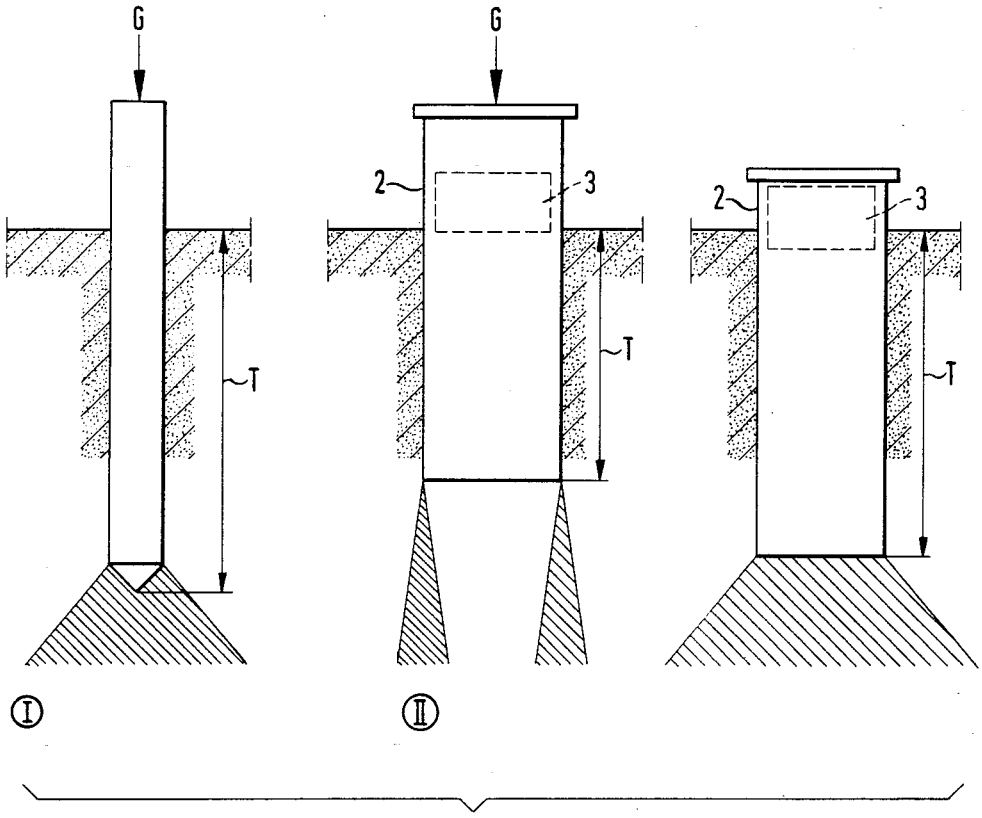
FIG. 4
FIG. 5
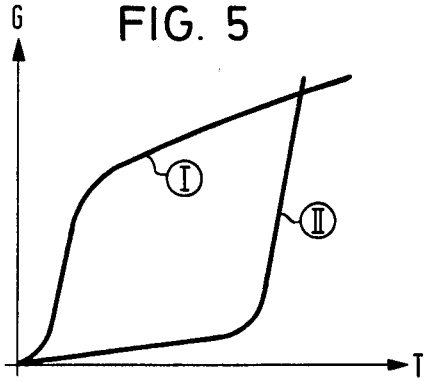

FOUNDATION FOR A MAST, SUPPORTING PILLAR, AND THE LIKE

BACKGROUND OF THE INVENTION (A) Field of the Invention

The instant invention relates to a foundation for a mast, in particular a steel tube mast, supporting pillar, rails, heavy construction machinery, and the like, comprising a ground anchoring portion of hollow section design which is open at its bottom and comprises, at its top, a connecting member for the mast or the like.

(B) Description of the Prior Art

Such a foundation is known, for example, from U.S. Pat. No. 1,784,568 which suggests that a releasable flange connection be provided between telephone poles and the like and the end of an anchoring portion set in concrete in the ground and being of tubular of H section. The anchoring of the tubular or H section member in the ground is effected by first excavating the ground at the place where the telephone pole is to be erected, subsequently the anchoring portion is secured in the hole in the ground, and finally concrete is poured into the hole to fill the same.

It is evident that the known solution requires a lot of material as well as time. And with greater foundations additional casing and supporting work is needed in the excavation to prevent any undesired break-in of earth which would pose constant danger to the construction workers who are fixing the anchoring portion in the hole. Besides, earth moving equipment (excavators) and concrete mixers etc. must be available to reduce the known solution to practice.

A very great disadvantage of the known solution is presented by the fact that the natural stability of the ground is destroyed by having to dig a hole for the construction of the foundation described. This lost stability essentially can be compensated only by an increased amount of concrete.

The solution known from U.S. Pat. No. 1,784,568 is not suited either for constructing the foundations of supporting pillars of large erecting shops and the like, the bottom of which is to be covered with asphalt or concrete upon levelling of the ground. With the known solution, the asphalt or concrete covering of the shop floor practically cannot be applied before the foundations for the supporting pillars are finished. This has the consequence that the work involved cannot be accomplished by means of large equipment alone but, in addition, requires small implements to be used in the direct vicinity of the foundations already constructed. Otherwise the concrete or asphalt floor could be provided only incompletely in the area of the foundations set, and subsequent manual work would be indispensable.

Swiss Pat. No. 589,772 discloses a tubular anchoring portion for steel masts and the like. This anchoring portion is driven into the ground and comprises an outer collar (flange) to provide increased lateral stability and lies on the surface of the ground when the anchoring portion is sunk into place. The drive-in of the tubular anchoring portion is facilitated by the lower end thereof being provided with a closed tip.

It is a disadvantage of this known solution that the tubular anchoring portion must be relatively slender in shape so as to keep the resistance against its being driven into the ground with reasonable limits. And yet the earth resistance cone is very high so that, consequently, strong forces must act on the anchoring portion in order to drive it into the ground. Usually this is accomplished by means of a drop hammer or ram. The risk of breakage of the anchoring portion is increased with this method. Furthermore, it cannot be avoided that the hole in the ground resulting from those impacts is beaten out or enlarged laterally, a circumstance which of necessity reduces the stability. This is the reason why the outer collar mentioned above is needed which has a much greater outer diameter as compared to the tubular anchoring portion. It is only by virtue of this overdimensioned outer collar that sufficient laterial stability is obtained.

The situation is similar to Swiss Pat. No. 589,772 with the solution proposed in 1899 in British Pat. No. 6349, leaving aside the fact that the latter comprises no separate anchoring portion, at the upper end of which the mast proper is fixed. Instead, the lower end of the mast has a tip, and an outer collar in the form of an annular or similar flange is provided spaced from the lower end of the mast. It is extremely complicated to drive the known mast into the ground. Practically, it can be done only with relatively short masts. With longer masts more expensive "digging in" cannot be avoided.

Finally, it is known from German utility model 1 964 445 to slip a mast of steel or aluminum sheet into a tubular ground anchoring member made of concrete or plastics and having previously been dug into the ground. The stability of this type of mast anchoring is very limited and, at best, sufficient for light masts of sheet material. The solution known from German utility model 1 964 445 is utterly unsuitable as the foundation of supporting columns of erecting shops or bridge piers.

SUMMARY OF THE INVENTION

It is, therefore, an object of the instant invention to provide a foundation for masts, supporting pillars, rails, and the like which is characterized by maximum stability at minor material expenditure and simple manufacture and which can be constructed especially also in pathless terrain.

It is another object of the instant invention to provide a simple method of constructing foundations of the kind mentioned.

As regards the foundation, the object is met, in accordance with the invention, in that the anchoring portion is driven into the ground, preferably by having been vibrated, and in that it comprises an inner ground consolidating elements, preferably in the form of at least one concrete insert, which element becomes effective at least during the final phase of the drive-in.

As regards the method, the object is met, in accordance with the invention, in that the ground anchoring portion of thin-walled hollow section design and provided with an inner ground consolidating element is sunk approximately vertically into the ground by being vibrated by means of a vibrator, preferably of high frequency, connected to the upper end of the anchoring portion and being suspended from construction equipment or an aircraft from which it is lowered at predetermined loading.

The anchoring portion of the foundation according to the invention is so designed that it can be driven into the ground by being vibrated at low, medium, or high frequencies, without meeting with any greater resistance. The earth resistance cone is extremely low during the drive-in work, yet much higher in fully driven-in condition than with any of the known structures, whereby a very high anchoring effect is achieved. These advantages surprisingly are achieved by anchoring portions of hollow section design having extremely thin walls which are not folded or bent during the vibrations in accordance with the invention. Rather, the vibrations cause the thin-walled hollow sectional material to enter the ground with ease, surprisingly even without damaging the surface which may be galvanized, for instance. For lengths up to 3000 mm of the anchoring portion the sheet thickness used ranges from 2.0 to 6.0 mm, preferably from 3 to 5 mm. Extremely little material is consumed as the invention permits the application of very thin walls.

Experiments on models have shown that an anchoring portion which consists of hollow sectional material approximately 3000 mm long, having cross sectional dimensions of 60×60 mm, and a weight of about 350 kg, and a wall thickness of approximately 5 mm can be driven into the ground by being vibrated at a load (weight of the vibrator) of no more than approximately 2.5 tons. On the other hand, about 15 tons are needed to pull the resulting foundation out of the ground. The loading or carrying capacity of such a foundation is in the range of 25 tons, i.e. at vertical loading by more than 25 tons, the foundation would sink further into the ground. During the vibrational entering of the anchoring portion embodied by hollow sectional material, the ground directly adjacent the wall of the anchoring portions becomes almost "flowing". In this manner the anchoring portion enters into the ground against relatively little resistance. As soon as the vibrations are terminated, the ground in the direct vicinity of the wall of the anchoring portion becomes solid practically instantaneously. Additional consolidation is obtained by the inner ground consolidating element and, possibly, the outer ground consolidating element provided in accordance with the invention. The high earth resistance cone of the foundation according to the invention upon being sunk into place is caused, among others, by the earth which entered the interior of the anchoring portion from below during the vibrational driving in procedure and which became highly consolidated so as to impart to the hollow section a stability corresponding to that of a solid body of ample dimensions.

In addition to its ground consolidating function, the inner ground consolidating element provided according to the invention has the further task of increasing the stability. As the anchoring portion has very thin walls, the section thereof which projects out of the ground is highly susceptible to bending and vibrational stresses. The inner ground consolidating element reinforces this sensitive section such that high bending and vibrational stresses can be accommodated. With the structure of the invention, lastly it is not the wall thickness of the hollow section used as anchoring portion which is decisive, but instead the mass composed of the hollow section, the ground enclosed in the interior thereof, and the ground consolidating element (concrete insert or the like).

Since the mast or supporting pillar, or the like is fixed in such manner on the foundation according to the invention that it will located entirely above ground, it is possible to use different materials for the anchoring portion (ground portion) and the portion above ground, i.e. the mast, supporting pillar, or the like. A material which is resistant against air corrosion but need not be resistant against earth corrosion may be chosen for the mast and the like. The opposite is true of the anchoring portion. A steel mast or pillar or the like preferably is made of carbon steel known by its trademark "Corten". This material is very inexpensive and highly resistant against air corrosion, whereas it is not resistant against earth corrosion (earth acids).

The very gentle introduction of the anchoring portion into the ground permits the use of the hollow sectional material which has very thin walls and consists of galvanized steel sheet. The zinc coating is not damaged since the ground in the direct neighborhood of the walls of the hollow sectional material becomes very loose, almost flowing, during the vibrational entry. The case is different if anchoring sections are hammered into the ground. With this method of introduction there is severe abrasion at the surface.

Of course, the materials and thicknesses of the sheet material for the anchoring portion are selected in consideration of the quality of the ground.

The ground consolidating element disposed inside the hollow sectional anchoring portion preferably consists of a plate of corrosion-resistant steel spaced from the upper end of the anchoring portion and extending across the free inner cross section thereof. This plate which either may be closed or designated as a narrow-mesh grid is connected to the insides of the hollow sectional anchoring portion by welding or by screws. With this design, the consolidation of the ground entering into the interior of the anchoring portion from below is effected during the final phase of the drive-in by vibrations.

The ground surrounding the outside of the anchoring portion may be consolidated by means of an outer ground consolidating element provided in the upper section of the anchoring portion, preferably spaced somewhat from the upper end thereof. This outer ground consolidating element is embodied by an annular, outwardly projecting collar (flange).

A very much preferred embodiment of the invention is characterized in that the inner and/or outer ground consolidating element is weighty or loaded and arranged for longitudinal displacement along the anchoring portion of the foundation. In this manner the ground adjacent the anchoring portion is influenced constantly by the ground consolidating element or elements for the entire period of the introduction of the anchoring portion under vibrations into the ground. This provides additional consolidation of the ground beyond the natural stability. The capability of "flowing" of the ground in the direct vicinity of the walls of the anchoring portion which preferably is embodied by hollow sectional material remains practically uninfluenced by the ground consolidating elements. The additional consolidation of the ground surrounding the anchoring portion as provided by the ground consolidating elements during the entire vibrational drive-in results in extraordinarily high stability of the foundation or the masts, pillars, and the like connected to the anchoring portion of the foundation.

Preferably the lower edge of the anchoring portion is toothed to facilitate driving in an anchoring portion into relatively hard or even frozen ground. When using a hollow cylindrical anchoring portion, additional rotational movement about the longitudinal axis of the anchoring portion may be superimposed over the vibrational motion in vertical direction.

The interior of the anchoring portion preferably tapers slightly conically from the bottom to the top (3° to 8°), while the outside surfaces extend parallel to each oher. This provides additional compacting during the vibrational drive-in procedure of the ground which enters from below into the interior of the anchoring portion. If the same effect is to be obtained at the outside of the anchoring portion as well, the outside surfaces thereof may be inclined slightly (3° to 8°) from top to bottom with respect to the longitudinal axis of the anchoring portion.

Preferably, the ratio between |the length of the anchoring portion| and |the outer diameter of a tubular anchoring portion or the greatest width of an anchoring portion of angular, preferably square cross section| and |the wall thickness of the anchoring portion| is approximately |1000 to 5000 mm|: |200 to 1500 mm|: |2.0 to 10.0, particularly 2.0 to 6.0 mm|. This ratio shows the minute wall thickness of the anchoring portion of the foundation according to the invention at extraordinarily high stability in the ground. Very little material is consumed, and the sinking into the ground causes absolutely no problem.

Foundations in accordance with the invention, among others, are suited also as provisional supports for heavy construction machinery, such as cranes, excavators, and the like used in pathless terrain. As explained, the foundations can be sunk or constructed very fast (about 50 to 90 seconds per foundation) and this by using light construction equipment or even from the air. Thus the construction of concrete bases for heavy cranes and the like may be dispensed with. The removal of foundations according to the invention is very easy, too, and poses no ecological problem.

A method of constructing a foundation for masts, supporting pillars, rails, heavy construction machinery, and the like, characterized in that the ground anchoring portion (2) of thin-walled hollow section design and provided with an inner ground consolidating element (plate 3, or concrete insert 3') is sunk approximately vertically into the ground by being vibrated by means of a vibrator, preferably of high frequency, connected to the upper end of the anchoring portion (2) and being suspended from construction equipment or an aircraft (zeppelin, helicopter, balloon) from which it is lowered at predetermined loading. The method is also characterized in that when using a longitudinally displaceable inner ground consolidating element (concrete insert 3'), first this element is positioned at the location where the foundation is to be constructed, then the anchoring portion (2) of hollow section design and open at the bottom is pushed over the ground consolidating element (concrete insert 3'), and finally the anchoring portion (2) is driven into the ground by being vibrated, taking along the inner ground consolidating element in the final phase or having it act increasingly on the ground inside the anchoring portion (2).

The method may be employed for constructing foundations for supporting pillars of an erecting shop having a concrete or asphalt floor, characterized in that the terrain on which the erecting shop is to be built first is levelled, compacted, and provided with an asphalt or concrete cover, in that then the asphalt or concrete layer is severed at the locations intended for positioning of the foundations and in correspondence with the cross section of the anchoring portions (2) used, thereby providing a longitudinally displaceable, inner ground consolidating element (concrete block, asphalt block, etc.), and in that finally the anchoring portion (2) is inserted with its lower open end into the severing cut and driven into the ground below the concrete or asphalt layer by being vibrated, at lease until the underside of the upper connecting flange or the upper connecting plate (13) abuts against the top of the cut out ground consolidating element (concrete or asphalt block). The foundations may be used for supporting masts, supporting pillars of erecting shops or the like, bridge piers, rails, heavy construction machinery (cranes, excavators, etc.) and the like. The concrete or asphalt block cut out of the concrete or asphalt floor may be loaded additionally, such as by another concrete block available or the like so as to increase the ground consolidating effect while the anchoring portion is driven in under vibrations.

Another advantage of the method resides in the guiding function of the severing cut for anchoring portion made in the concrete or asphalt floor and in the stabilizing effect of the concrete or asphalt floor surrounding the anchoring portion.

Contrary to the known method mentioned initially in respect of the construction of the floor of a big hall, large construction machinery may be used with the method and at least they are not impeded by any foundations laid earlier. The floor of the hall may be treated speedily and accurately.

BRIEF DESCRIPTION OF THE DRAWINGS

Preferred embodiments of the invention will described further below, with reference to the accompanying drawings, in which FIG. 1 is a side elevational view, partly in section, of a foundation comprising a hollow cylindrical anchoring portion driven into the ground and a steel plate as the inner ground consolidating element;

FIG. 2 is a sectional view of another embodiment of a foundation, comprising an anchoring portion driven into the ground and being of square hollow section design having an outer collar-like ground consolidating element and an inner, longitudinally displaceable ground consolidating element (concrete block);

FIG. 3 is a sectional elevation of the anchoring portion shown in FIG. 2 along line III—III;

FIG. 4 is a diagrammatic representation of the "earth resistance cone" according to the invention as compared to the state of the art; and FIG. 5 is a graphical presentation of the course of the earth resistance with the embodiments shown in FIG. 4, plotted above the depth of penetration into the ground.

DESCRIPTION OF PREFERRED EMBODIMENTS

In the case of the embodiment shown in FIG. 1 the foundation for a mast 1 consists of a hollow clyindrical anchoring portion 2 driven approximately vertically into the ground by application of vibrations. The mast 1 is connected by means of flanges to the upper end of the anchoring portion 2. A steel plate 3 is connected by welding to the interior of the hollow cylindrical anchoring portion 2, spaced from the upper end thereof, additional reinforcing angle pieces 5 being provided between the anchoring portion 2 and the ground consolidating plate 3 to increase the rigidity. When the anchoring portion 2 is driven in, the ground consolidating plate 3 lies more or less spaced below the top of the ground, depending on the earth resistance. At any rate, the arrangement described of the ground consolidating plate 3 guarantees that the ground is consolidated inside the anchoring portion during the final phase of the vibrational drive-in procedure. A ventilation aperture 12 is provided in the sidewall of the anchoring portion 2 just below the ground consolidating plate 3 to permit the air trapped inside the anchoring portion to escape to the outside while the anchoring portion 2 is driven into the ground. The mast 1 which always is positioned above ground is releasably secured by threaded bolts 10 to an upper closing plate 13 of the foundation or anchoring portion 2, a corresponding fastening flange 9 being provided at the lower end of the mast 1.

The lower edge 8 of the sleeve-like anchoring portion is toothed to facilitate its being driven vibratingly into the ground. To this end, the anchoring portion, at the same time, may be rotated about its longitudinal axis. Thus with the embodiment diagrammatically shown in FIG. 1, first only the anchoring portion 2 is driven into the ground and subsequently the mast proper is connected by means of the flanges. As explained above, the cross section of the anchoring portion 2 also may be rectangular, preferably square. At a length of from 1000 to 5000 mm of the anchoring portion 2 in that event the edge length will be from about 200 to 1500 mm and the wall thickness approximately from 2 to 10 mm, preferably 3 to 6 mm.

For greater sheet thicknesses of the anchoring portion 2, FIG. 1 indicates that the ground consolidating plate 3 may be replaced by a concrete insert in the upper range of the anchoring portion 2 having the same ground consolidating effect during the final phase of the sinking into the ground.

The total foundation as shown in FIG. 1, including the ground consolidating plate 3 and, if desired, reinforcement angle pieces 5 has a weight of approximately 100 to 2000 kg, depending on the length, cross section, and sheet thickness of the hollow sectional anchoring portion. It was found that extremely great rigidity and high anchoring effect are obtained without any additional reinforcements or the like in spite of the very thin wall thickness of the sleeve-like anchoring portion. The natural firmness of the ground is not destroyed when driving in under vibrations the anchoring portion in accordance with the invention; rather it is enhanced still further by the inner ground consolidating plate 3 and, if desired, an additional outer ground consolidating element as shown in FIG. 2. Preferably, also the outer ground consolidating element 4 is spaced a little from the top end of the anchoring portion 2. The distance of the inner and, perhaps, also the outer ground consolidating elements from the upper end of the anchoring portion is from about 3/100 to 10/100 of the length of the anchoring portion 2. The embodiment according to FIGS. 2 and 3 shows the anchoring portion 2 to be of square hollow sectional material having the same edge length each. An outer ground consolidating element in the form of a collar 4 is provided at the upper end of the square hollow section. The collar 4 is a sheet metal structure having a peripheral flange 6 and angle sheet pieces or gussets 7 welded to the underside thereof. A total of four such gussets 7 are provided in the area of the center lines of the four sides of the hollow section such that they are spaced uniformly around the circumference of the hollow section. The respective upper horizontally extending legs of the gussets 7 are welded to the underside of the peripheral flange 6, while the other legs of the gussets 7, extending approximately vertically, are secured, preferably also by welding to the outer shell of the hollow section or anchoring portion 2.

With the embodiment shown in FIGS. 2 and 3 the inner ground consolidating element in the form of a concrete insert 3' is arranged for longitudinal displacement inside the anchoring portion 2 so that it will act on the ground entering from below into the interior of the anchoring portion 2 for the whole time of the vibrational movement. A ventilation aperture 11 is provided at the upper end of the anchoring portion 2 to permit the escape of air present above the inner concrete insert 3' during the vibrational movement, possibly together with any concrete dust resulting from the vibrations. The lower end of the anchoring portion 2 is formed with prongs (four prongs at the four corners of the anchoring portion) so as to obtain a minimum earth resistance cone, thereby additionally reducing the resistance of the ground when driving in the foundation. The overall weight of the concrete insert 3' is between approximately 100 kg and 300 kg. It depends, among others, on the property of the ground. The anchoring portions 2 disposed below ground level each are made of highly corrosion-proof steel, such as chromium steel which is resistant also against earth acids etc. The mast 1 or the like disposed above ground level preferably is made of air corrosion resistant material, including wood.

In addition to their ground consolidating effect, the inner and, if desired, outer ground consolidating elements 3, 3', and 4 have the advantageous effect of providing increased buckling strength of the foundation in the upper connecting area with the mast, supporting pillar, or the like. On the whole, the foundation according to the invention proves to be very stable against oscillations, bending stress, and tensional as well as compressive strains.

Preferably the anchoring portion 2 is made of ferritic chromium steel having a low carbon content and, selectively, containing molybdenum, as is the case with the ground consolidating plate 3 of the embodiment shown in FIG. 1.

It should be added with respect to the embodiment shown in FIGS. 2 and 3 that the ratio between |the outer diameter of the collar 4| and |the edge length of the anchoring portion 2| is between approximately 2:1 and 4:1.

If the anchoring portion 2 is embodied by a hollow cylinder, helical grooves or fins may be formed in the outer shell thereof to effect rotary movement of the anchoring portion 2 about its longitudinal axis as it is driven into the ground.

This rotary movement causes the lower edge of the anchoring portion 2, which may be toothed for instance as shown in FIG. 1 to act like a saw.

The advantages of the foundation according to the invention are particularly conspicuous from the presentations of FIGS. 4 and 5. Experiments on models have shown that the "earth resistance cone" is relatively great, i.e. has a relatively great cone angle when a slender pole of FIG. 4I is beaten into the ground, of presentation I in FIG. 4. With the hollow sectional anchoring portion 2 according to the invention, on the other hand, the "earth resistance cone" is very small as this anchoring portion is driven into the ground while being vibrated. The hollow sectional material behaves like a knife edge. When fully sunk into place, however, the anchoring portion 2 has a very great "earth resistance cone" since the ground present inside the hollow section of the anchoring portion 2 imparts to this anchoring portion 2 the property of a solid body of the kind of a very thick pole (cf. presentation II in FIG. 4 before and after sinking).

The course of the passive earth pressure or earth resistance G of the two embodiments compared in FIG. 4 is shown plotted above the depth of penetration T in FIG. 5. Thus the earth resistance is relatively high from the beginning with respect to embodiment I of FIG. 4, whereas the earth resistance G rises above proportion only during the final phase of the vibrational drive-in procedure in the case of the embodiment according to the invention as represented by presentation II in FIG. 4.

By the way, presentation I of FIG. 4 is comparable to the known solution offered by Swiss Pat. No. 589,772 and British Pat. No. 6349.

All the features disclosed in the instant documents are claimed as essential of the invention to the extent that they are novel over the state of the art, either individually or in combination.

What is claimed is:

1. A foundation to provide support for a structure, which foundation comprises in combination:
   (a) an elongated, hollow, thin wall design section element having an upper end and a bottom end and having a free cross section at the upper end thereof and having a ground anchoring portion open at the bottom end, the ground anchoring portion driven generally vertically into the ground; and
   (b) an inner ground consolidating means to consolidate the ground within the section element while the ground anchoring portion is being driven generally vertically into the ground, said means comprising a heavy weight arranged for longitudinal displacement along the ground anchoring portion of said section element whereby consolidation of the ground directly beneath said means is effected during the period of driving the ground anchoring portion into the ground, so that the earth resistance cone is small during the driving phase and high after the driving phase.

2. The foundation as claimed in claim 1 wherein the foundation has a weight of approximately 100 to 2000 kg.

3. The foundation as claimed in claim 1 wherein the section element is characterized as being of a square hollow section design.

4. The foundation as claimed in claim 1 wherein the inner ground consolidating means comprises a concrete insert element placed inside the upper end of the anchoring portion within the free cross section.

5. The foundation as claimed in claim 4 when the weight of the concrete insert element is between approximately 100 to 300 kg.

6. The foundation as claimed in claim 1 wherein the ground anchoring portion has a lower edge, which lower edge is characterized by teeth or prongs generally uniformly spaced along the circumferance of the lower edge.

7. The foundation as claimed in claim 1 wherein the ground anchoring portion is characterized in that the ground anchoring portion tapers generally conically from the bottom to the top, while the outside surface of the ground anchoring portion extends generally parallel to each other.

8. The foundation as claimed in claim 1 which includes an outer ground consolidating collar extending generally laterally outward from the upper end of the section element and spaced slightly apart from the upper end of the anchoring portion an above the ground to increase the stability of the foundation.

9. The foundation as claimed in claim 8 wherein the ratio between the outer diameter of the outer consolidation element and the edge length of the anchoring portion is between about 2 to 1 and 4 to 1.

10. The foundation as claimed in claim 8 wherein the outer ground consolidating collar is arranged for longitudinal displacement along the anchoring portion and is loaded by a heavy weight ranging from about 10 to 250 kg, whereby consolidation of the ground directly surrounding the anchoring portion is affected during the period of driving the anchoring portion into the ground.

11. The foundation as claimed in claim 1 wherein the anchoring portion includes a ventilation aperture means at the upper end thereof to permit air trapped inside the anchoring portion to escape to the atmosphere.

12. The foundation as claimed in claim 1 characterized in that the ratio between the length of the anchoring portion and the outer diameter of the anchoring portion and the wall thickness of the anchoring portion respectively is 1000 to 5000 mm: 200 to 1500 mm: and 2.0 to 10.0 mm.

13. The foundation as claimed in claim 1 wherein the interior of the anchoring portion tapers slightly conically from the bottom to the top in an amount of from about 3 to 8°, while the outside surfaces of the anchoring portion generally extend parallel to each other.

14. The foundation as claimed in claim 1 wherein the elongated, hollow design, thin wall section element has a sheet thickness ranging from about 2.0 to 6.0 mm.

15. The foundation as claimed in claim 1 which includes a support structure secured to the upper end of the elongated hollow design section element supported by the foundation of claim 1.

16. The foundation as claimed in claim 1 which includes vibrator means connected to the upper end of the anchoring portion of the section element to provide vibrations to the upper end of the anchoring portion to drive the bottom end of the ground anchoring section generally vertically into the ground to the desired level and to consolidate ground in the interior of the hollow section element and beneath the interior ground consolidating means.

17. A foundation to provide support for a structure, which foundation comprises in combination:
   (a) an elongated, hollow, thin wall design section element having an upper end and a bottom end and characterized by a square, hollow design and having a free cross section at the upper end therof and having a ground anchoring portion open at the bottom end, the ground anchoring portion driven generally vertically into the ground;
   (b) an inner ground consolidating means to consolidate the ground within the section element while the ground anchoring portion is being driven generally vertically into the ground, said means comprising a heavy weight arranged for longitudinal displacement along the ground anchoring portion of said section element whereby consolidation of the ground directly beneath said inner means is effected druing the period of driving the ground anchoring portion into the ground, so that the earth resistance cone is small during the driving phase and high after the driving phase; and
   (c) an outer ground consolidating collar extending generally laterally outward from the upper end of the section element and spaced slightly apart from the upper end of the anchoring portion and above the ground to increase the stability of the foundation.

* * * * *